US006696129B1

(12) United States Patent
Cotton

(10) Patent No.: US 6,696,129 B1
(45) Date of Patent: Feb. 24, 2004

(54) QUILT CONSTRUCTION AND METHOD FOR MAKING SAME

(76) Inventor: Betty L. Cotton, P.O. Box 277, Osseo, WI (US) 54758

( * ) Notice: Subject to any disclaimer, the term of this patent is extended or adjusted under 35 U.S.C. 154(b) by 0 days.

(21) Appl. No.: 10/291,316

(22) Filed: Nov. 8, 2002

(51) Int. Cl.[7] ..... B32B 3/06

(52) U.S. Cl. ..... 428/102; 428/57; 428/61; 112/117

(58) Field of Search ..... 428/57, 61, 102; 112/117; 5/505, 482

(56) References Cited

PUBLICATIONS

ASTM "Standard Terminology of Seams and Seam Finishes Used in Home Sewing," Jul. 1996, Designation: D 4965–96, ASTM. United States.

*Primary Examiner*—Alexander S. Thomas

(74) *Attorney, Agent, or Firm*—Anthony J. Bourget

(57) ABSTRACT

A quilt segment construction and method for making quilted segments and quilts, the quilt segment of one aspect of the invention comprising a first piece of quilted fabric stitched to a second piece of quilted fabric to define a seam line and a first piece seam allowance and a second piece seam allowance each positioned at a front face of the quilt segment, the first seam allowance double folded and enclosing the second seam allowance, the first seam allowance folded to the seam line and stitched over the seam line through to a back face of the quilt segment.

37 Claims, 12 Drawing Sheets

QUILT CONSTRUCTION AND METHOD FOR MAKING SAME

FIELD OF THE INVENTION

This invention relates to quilted articles, and more particularly to a quilt construction and method of making the quilted articles.

DESCRIPTION—BACKGROUND OF PRIOR ART

Common quilts and quilting methods include stitching together pieces of material, sometimes scraps, or a variety of pieces of fabric to create a top layer which is joined with a lower layer and usually filled with a batting. The top layer is sometimes prepared to present an artistic array of colors, shapes or patterns. Various sewing lines or patterns can be included. Typically, the bottom layer consists of one fabric. The bottom layer generally is not a desirable side of the quilt.

A traditional method for making a quilt includes stitching together the various top pieces to form the top layer. Seam allowances or stitch lines are positioned on the back side or underside of the top layer or toward the inside of the quilt such that raw seam edges are not exposed. The top and bottom layers will vary in size. Prior to sewing, a batting is often inserted between the two layers, and the three layers are subsequently stitched together. For larger quilts the finishing usually requires use of a specialized sewing machine. Because the center area of a large-dimension quilt are spaced a considerable distance from the raw edges of the quilt, a standard domestic size sewing machine cannot extend from center to perimeter. Care is often required in finishing the quilt due to the possible shifting of the batting and misalignment of the top and bottom layers. The quilt usually must lie flat for proper finishing and to assure a wrinkle free and properly aligned finish. Accordingly, special sewing machines having long or no arms are often used for finishing standard quilts. Such sewing machines are expensive for most people who enjoy quilting, they take up space and require further skill to operate.

Common quilts also are designed with a dominant side, which is typically the top layer containing the design. Using common techniques it is difficult to create a quilt that is reversible in that both front and back sides are dominant or finished with a desired design. To create a quilt with a reversible design generally requires the creation of two separate layers each having a design such that when they are sewn together each respective design is observed. Again, specialized finishing equipment is usually required to properly combine a front and back design.

Common quilting techniques are also time consuming in that considerable effort is devoted to creation of an elaborate top layer pattern which may often be delayed due to stitching or layout mistakes and the like. The process of finishing a large or oversize quilt takes special talent and is often time consuming. Further, since most quilters do not possess an industrial quilting machine or hire quilt finisher, the long-awaited finished quilt top is usually delayed while attempting to schedule an appointment with a finisher and actually delivering and picking up the finished quilt. Quilt finishing can be very expensive and is a major deterrent for quilters or would-be quilters.

Common quilting techniques are also complicated. Beginning quilters often experience frustrations or are often deterred from even beginning a quilting project. Completing a quilt can be a large undertaking, especially when the desired project is also large (such as with a spread for a king-sized bed) or contains an elaborate design. Quilters can be overwhelmed with a project such that they will avoid future projects or never even begin one. Making the quilting project manageable or breaking it down into smaller steps would give quilters confidence and help them accomplish their goal.

Some quilts are made under a quilt-as-you-go method. In one typical quilt-as-you-go method, a variety of smaller or miniature quilts (which may or may not include batting and quilt lines) are prepared and sewn together to create a larger quilt. Generally, one miniature pre-quilted piece is sewn together to an adjacent quilted piece, such that a raw edge or seam allowance is showing. These raw edges present an unfinished look and are undesirable by most quilters and consumers. The rough edges often look unfinished and unsightly and have a greater tendency to snag, unravel or become damaged. Thus, with some traditional quilt-as-you-go methods, the maker generally applies an additional strip of fabric to cover the exposed seam. The additional fabric is usually sewn over the top of the exposed seam. This creates additional expense and work in creating a desired quilt and also lessens the flexibility in creating the desired artistic design feature. Use of additional material includes the possibility of having unfinished seam allowances or portions which are not tied down sufficiently. Various methods address the seam allowances by concealing them to the inside of the quilt (i.e., covered between the front and back layers), by concealing them with extra pieces (often with hand stitching), or by leaving the raw edges of the allowances showing.

Traditional quilts also tend to be flat or lack a unique 3-Dimensional aspect. For instance, while traditional quilts may sometimes have exposed seam allowances that are subsequently covered, or which contain raw edges, or in some instances may incorporate strands or yarns tied or knotted to the quilt, they do not have seam allowances with an unstitched folded edge or that are otherwise externally finished seam allowances. An externally finished seam allowance, i.e., a seam allowance finished on a front or visible side and having an unstitched projecting folded edge without raw or rough edges, provides a dimension of quality, style, visual distinction and comfort to an otherwise traditional quilt.

It is thus an object of the present invention to provide an alternative construction and method for constructing a quilted article and quilted segments which overcome the drawbacks and limitations of traditional quilts and quilting methods.

It is also an object of the present invention to provide an alternative construction and method for constructing a quilted article which can be completed entirely with use of standard domestic sewing machine equipment.

It is also an object of the present invention to provide a construction and method for constructing a quilted article in a "quilt-then-assemble" fashion without the need of additional covering pieces.

It is a further object of the present invention to provide a construction and method for constructing a quilted article where the seam allowances are finished on a visible or outer surface of the quilt, and on either and/or both sides of the quilt.

It is yet a further object of the present invention to provide a construction and method for constructing a quilted article such that the quilt is reversible or has both dominant front and back layers.

It is yet another object of the present invention to provide a construction and method for constructing a quilted article with finished 3-Dimensional seam allowances.

It is yet a further object of the present invention to provide a construction and method for constructing a quilted article that is uncomplicated, manageable, and reversible. These and other objects of the invention will become apparent in light of the present specification.

BRIEF SUMMARY OF THE INVENTION

The present invention is directed to quilts and quilt segment constructions and methods for making quilted segments and quilts. One embodiment is directed to a method for the fabrication of a quilt segment for use in fabrication of a quilt, the method comprising the steps of providing a first piece of fabric having at least one seam allowance, providing a second piece of fabric having at least one seam allowance, stitching the first piece to the second piece to form a seam line, the at least one seam allowance of the first piece positioned at a front face of the quilt segment, folding the seam allowance of the first piece to the seam line, and stitching the folded seam allowance of the first piece through to a back face of the quilt segment and over the seam line. The seam allowance is at least double folded and defines a finished lip.

Another embodiment of the invention includes a method for the fabrication of a quilt segment for use in fabrication of a quilt, the aid method comprising the steps of providing a first piece of fabric having at least one seam allowance, providing a second piece of fabric having at least one seam allowance, stitching the first piece to the second piece to form a seam line, the at least one seam allowance of the first piece positioned at a front face of the quilt segment and having a raw edge, at least single folding the seam allowance of the first piece to a left side of the segment to define a first piece folded edge, the raw edge folded to the seam line, at least double folding the at least one seam allowance of the second piece to the left side to define a second piece first folded edge and a second piece second folded edge, the seam allowance of the second piece covering the raw edge, the second piece first folded edge folded to the seam line, and stitching the seam allowance of the second piece through to a back face of the quilt segment and over the seam line, the first piece folded edge and the second piece second folded edge each defining a finished lip.

Another embodiment of the invention includes a method for the fabrication of a quilt segment for use in fabrication of a quilt, the method comprising the steps of providing a first piece of fabric having at least one seam allowance, providing a second piece of fabric having at least one seam allowance, stitching the first quilted piece to the second quilted piece to form a seam line, the at least one seam allowances of the first and second quilted pieces positioned at a front face of the quilt segment, at least double folding the seam allowance of the first quilted piece to create a first folded edge and a second folded edge, stitching the first folded edge through to a back face of the quilt segment, the second folded edge projecting from the front face.

Another embodiment of the invention includes a quilt comprising at least one first segment comprising a first piece having at least one seam allowance positioned at a front face of the first segment, a second piece having at least one second seam allowance, the first piece stitched to the second piece at a seam line, the seam allowance of the first piece stitched over the seam line through to a back face of the first segment, the first segment having a first segment seam allowance, at least one second segment having at least one second segment seam allowance, the first segment stitched to the second segment at a second seam line, the seam allowance of the second segment folded to define a first folded edge, the first folded edge folded to the second seam line, the first folded edge stitched through to a back face of the quilt and over the second seam line. The seam allowance of the second segment is at least double folded and defines a finished lip.

Another embodiment of the invention includes a quilt segment for use in fabrication of a quilt, the quilt segment comprising a first piece of fabric having at least one seam allowance, a second piece of fabric having at least one seam allowance, the first piece stitched to the second piece defining a seam line, the at least one seam allowance of the first piece positioned at a front face of the quilt segment, the seam allowance of the first piece folded to the seam line, the folded seam allowance of the first piece stitched over the seam line through to a back face of the quilt segment. The seam allowance of the first piece is at least double folded and defines a finished lip.

Another embodiment of the invention includes a quilt segment for use in fabrication of a quilt, the quilt segment comprising a first piece of quilted fabric stitched to a second piece of quilted fabric defining a seam line and a first piece seam allowance and a second piece seam allowance, each of the seam allowances positioned at a front face of the quilt segment, the first seam allowance double folded and enclosing the second seam allowance, a folded edge of the first seam allowance aligned with the seam line and stitched over the seam line through to a back face of the quilt segment. The first seam allowance defines a finished lip.

DETAILED DESCRIPTION OF THE PREFERRED EMBODIMENTS

Figure 1:
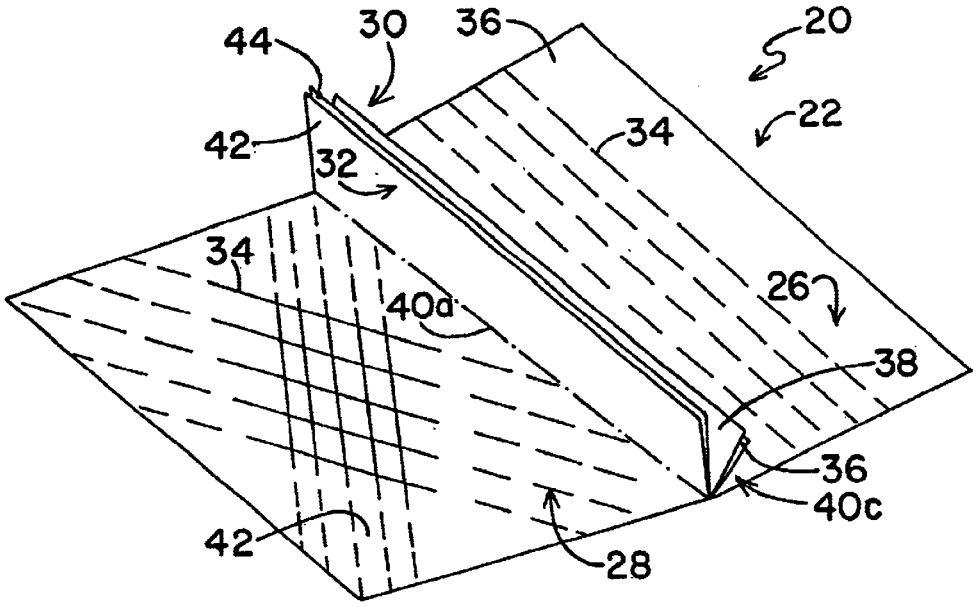
FIG. 1 is a top perspective view of a quilt segment partially made in accordance with the present invention.
Figure 2:
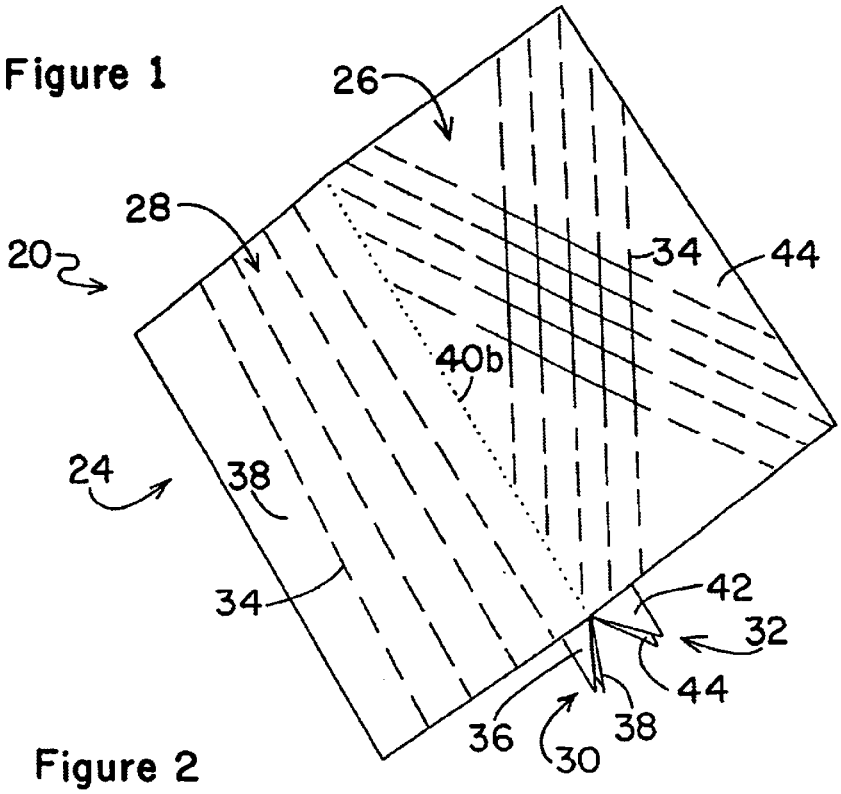
FIG. 2 is a bottom perspective view of the quilt segment shown in FIG. 1.

FIGS. 1 and 2 represent an early stage in the fabrication of quilt segment 20. Quilt segment 20 includes front face 22 and back face 24. While it may be appreciated that non-quilted pieces may be used, segment 20 preferably includes a first quilted piece 26 and a second quilted piece 28. As shown, each quilted piece includes quilting lines 34 which may consist of any desired pattern, design or arrangement, and are generally made with typical sewing thread (i.e., regular weight #50). A batting 54 is preferably inserted between first piece front face layer 36 and first piece back face layer 38. Batting 54 may also be inserted between second piece front face layer 42 and second piece back face layer 44. Preferably, batting 54 is pre-cut smaller than the layers 42, 44 so as to not be a part of the seam allowances as described below.

Figure 3:
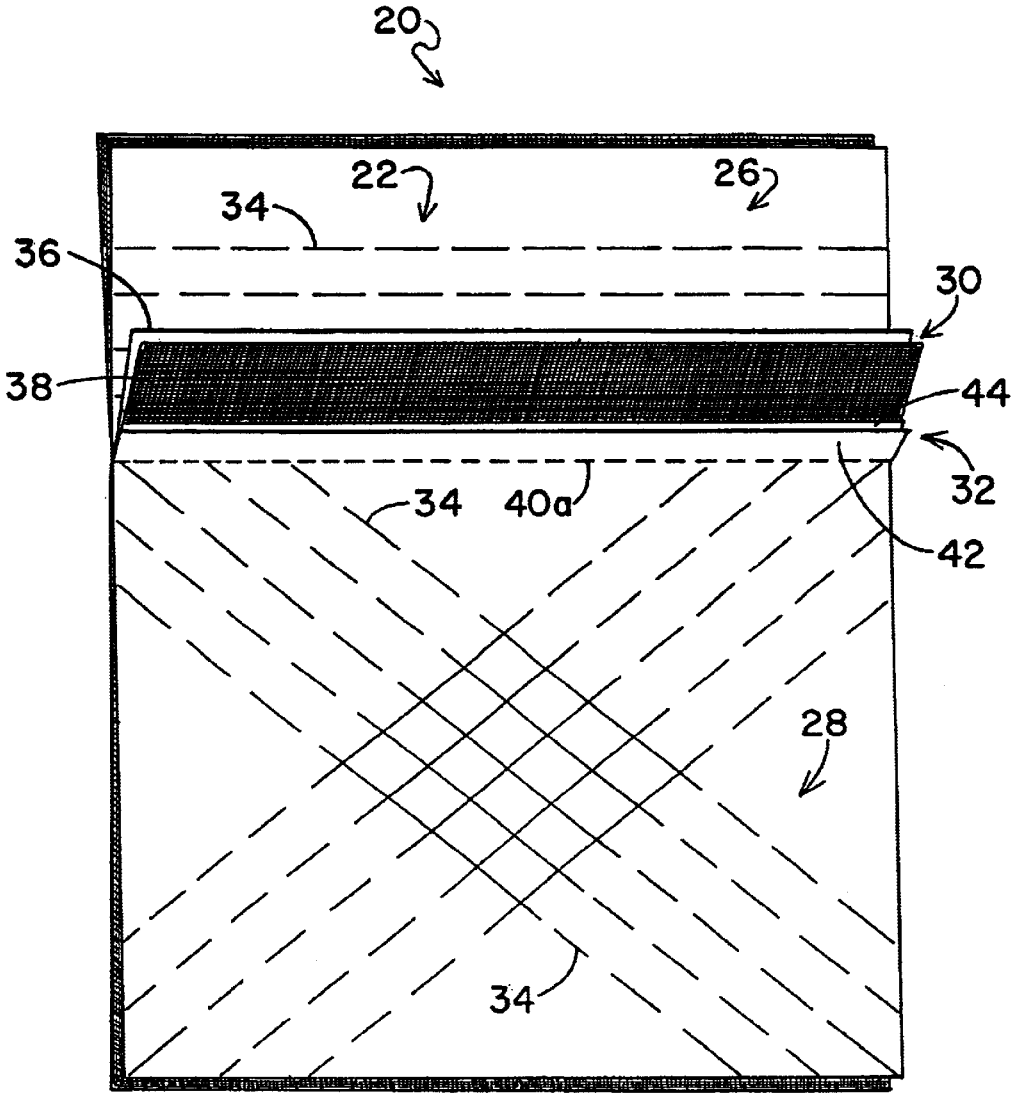
FIG. 3 is a top perspective view of the quilt segment shown in FIG. 1 having a trimmed seam allowance.

First quilted piece 26 is sewn to second quilted piece 28 at seam line 40. Typically, first piece back face layer 38 mates with second piece back face layer 44 and is then stitched to form seam line 40. Preferably only one line of stitching is used to create seam line 40. Seam line 40, as further described at seam line 40*a*, 40*b*, and 40*c* is made of a common stitching. The stitching thread of seam line 40*a* is typically in plain view as shown in FIG. 1 and FIG. 3. Likewise, and prior to folding and stitching of the seam allowances 30 and 32 as described below, the stitching thread of seam line 40*c* is typically in plain view as would be seen from a reverse angle of FIG. 1 and FIG. 3. The stitching thread of seam line 40*b* tends to be less visible except if one attempts to pull the first piece 26 away from second piece 28 (See for instance FIG. 8).

When first piece 26 and second piece 28 are laid flat as shown in FIG. 1, first piece seam allowance 30 and second piece seam allowance 32 are positioned to the front face 22. First piece seam allowance 30 includes a portion of front face layer 36 and a portion of back face layer 38 extending from the seam line 40. Second seam allowance 32 includes a portion of front face layer 42 and a portion of back face layer 44 extending from the seam line 40. Preferably seam line 40 is sewn along the edge of the battings 54 of both the first piece 26 and second piece 28. While the sewing of seam line 40 preferably penetrates an edge of batting 54, batting 54 preferably does not extend substantially within seam allowances 30 and 32.

Figure 4:
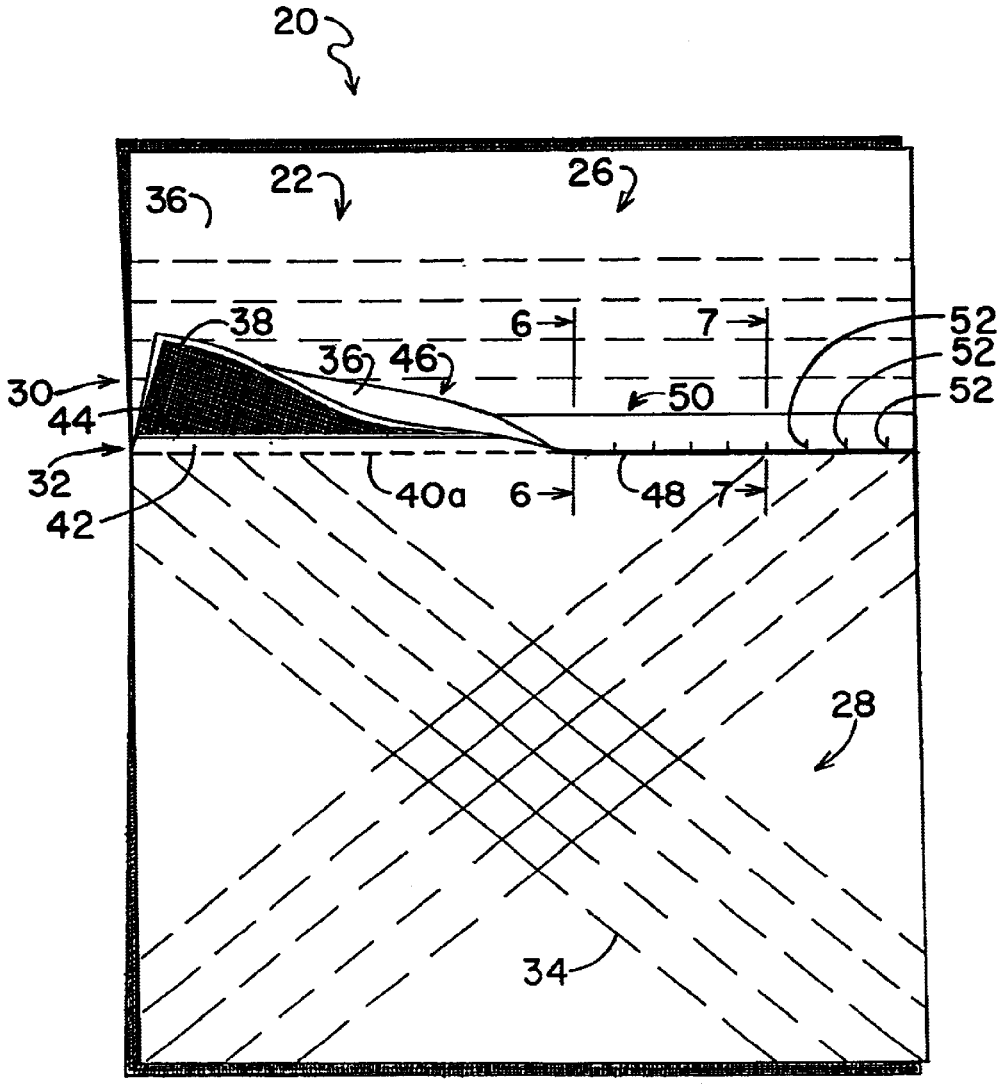
FIG. 4 is a perspective view of the quilt segment shown in FIG. 1 having a partially folded and partially stitched seam allowance.
Figure 6:
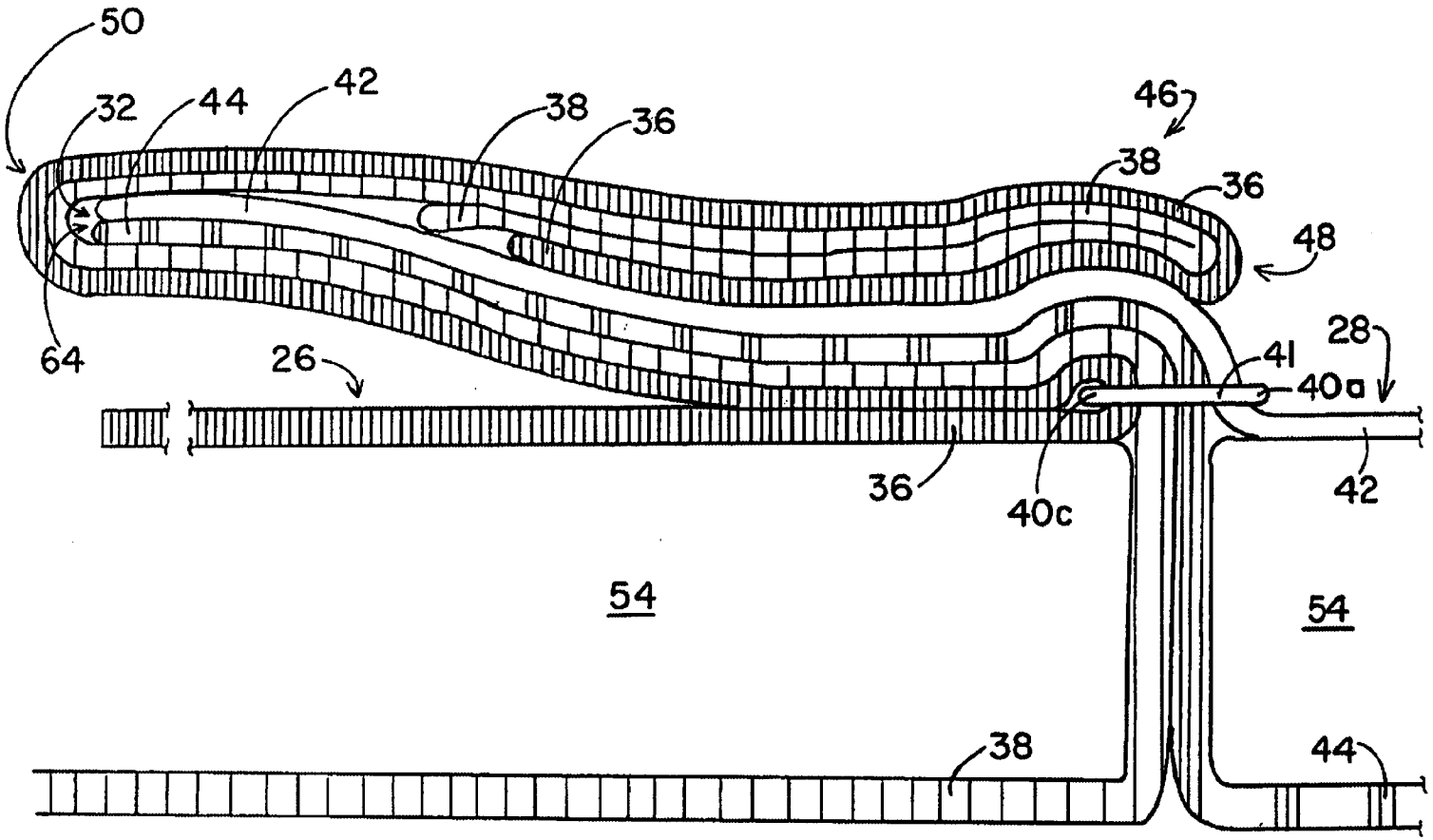
FIG. 6 is a section view of the quilt segment, taken generally along line 6—6 in FIG. 4.
Figure 8:
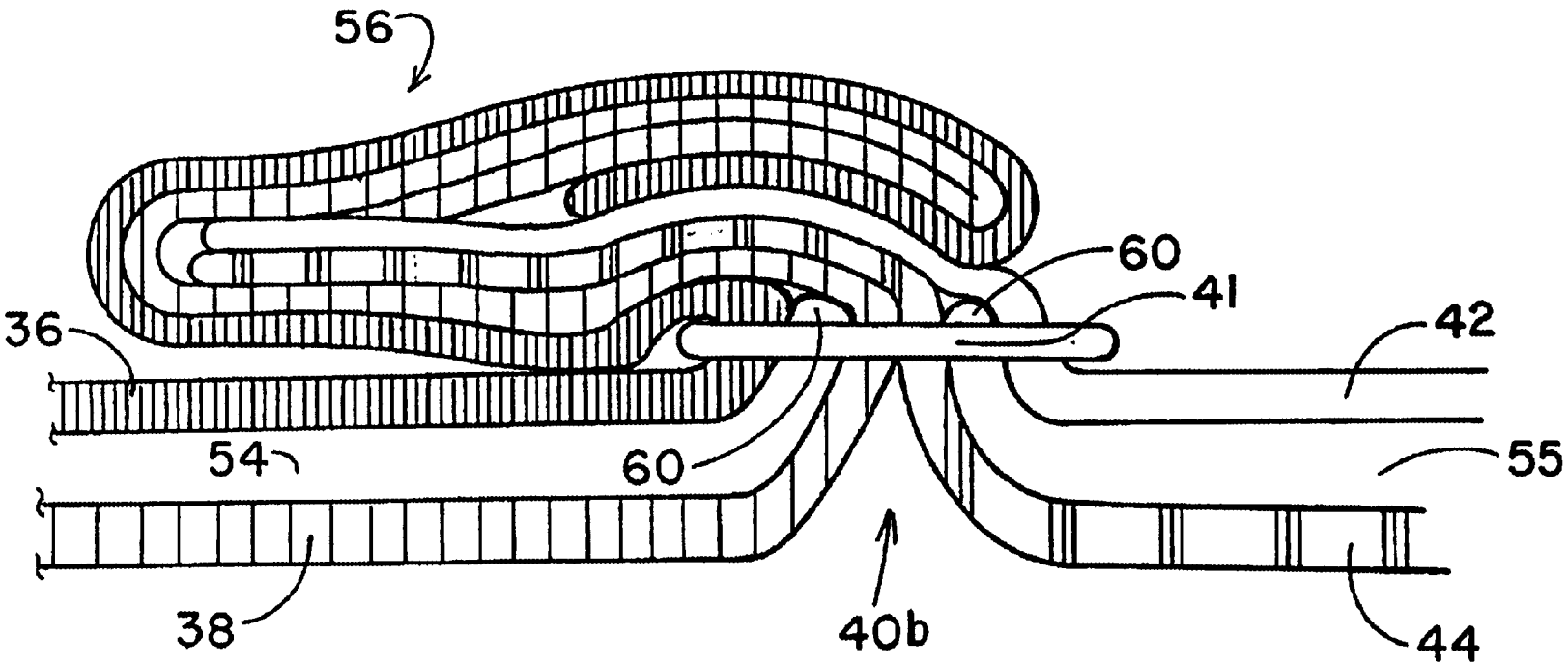
FIG. 8 is a section view of the quilt segment showing batting sewn into the seam line.

In one aspect of the present invention as shown in FIG. 3, seam allowance 32 is preferably pressed and trimmed length-wise. In this case both front face layer 42 and back face layer 44 are trimmed. Such trimming eliminates bulk for easier folding and finishing, especially in the case of the double folding described below. As shown in FIG. 4, first seam allowance 30 is folded to form a first folded edge 46. Seam allowance 30 is further folded to form a second folded edge 50. In one aspect of the present invention, the above double folding encloses second seam allowance 32 as shown in FIG. 6. Second seam allowance 32 is folded with and within first seam allowance 30. Enclosing seam allowance 32 includes enclosing the second piece raw edges 64 of front face layer 42 and back face layer 44. When first piece 26 is top stitched to second piece 28 to form seam line 40, seam line stitch 41 penetrates through first quilted piece 26 and second quilted piece 28 as shown in FIG. 6 and FIG. 8. Alternatively, it can be appreciated that second piece 28 is top stitched to first piece 26 to create the seam line 40.

Figure 5:
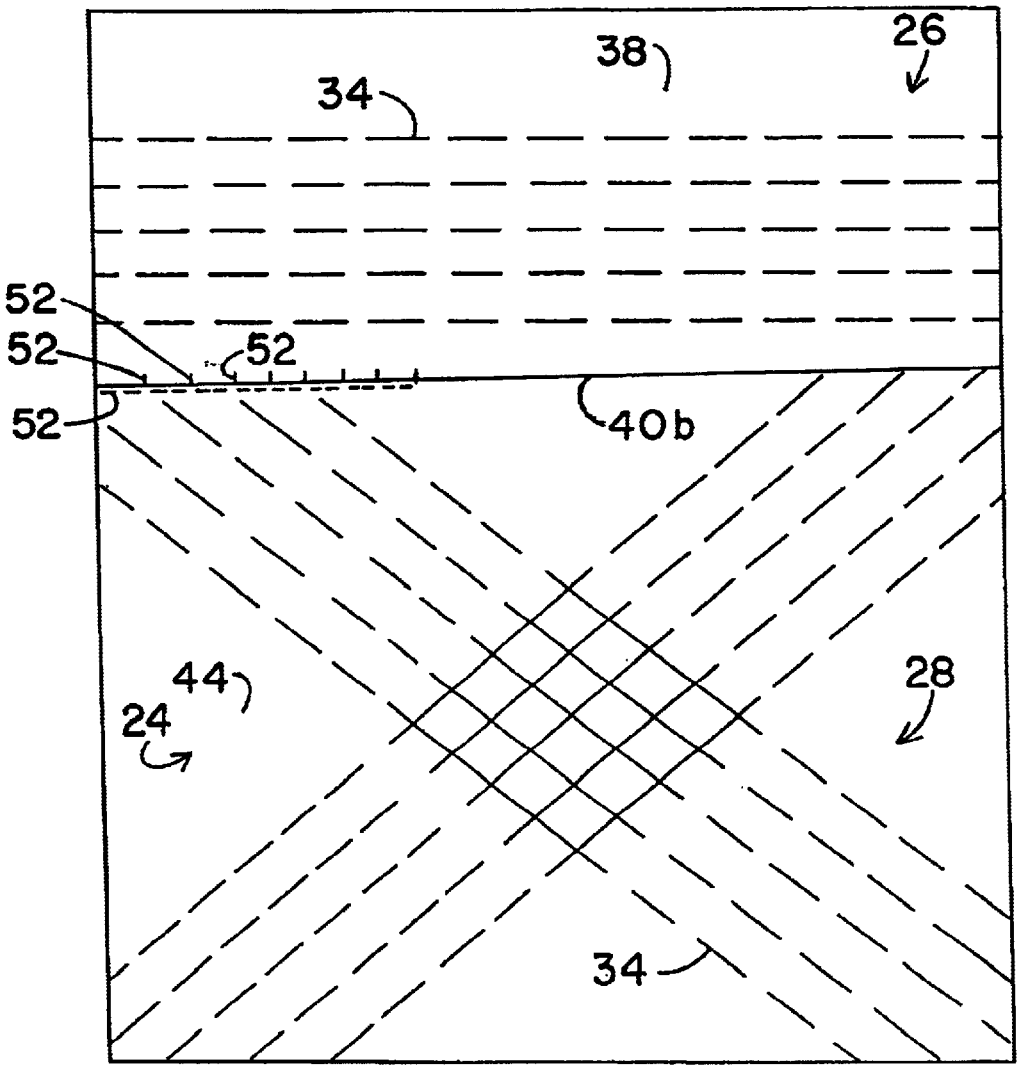
FIG. 5 is a bottom view of the quilt segment shown in FIG. 4.
Figure 7:
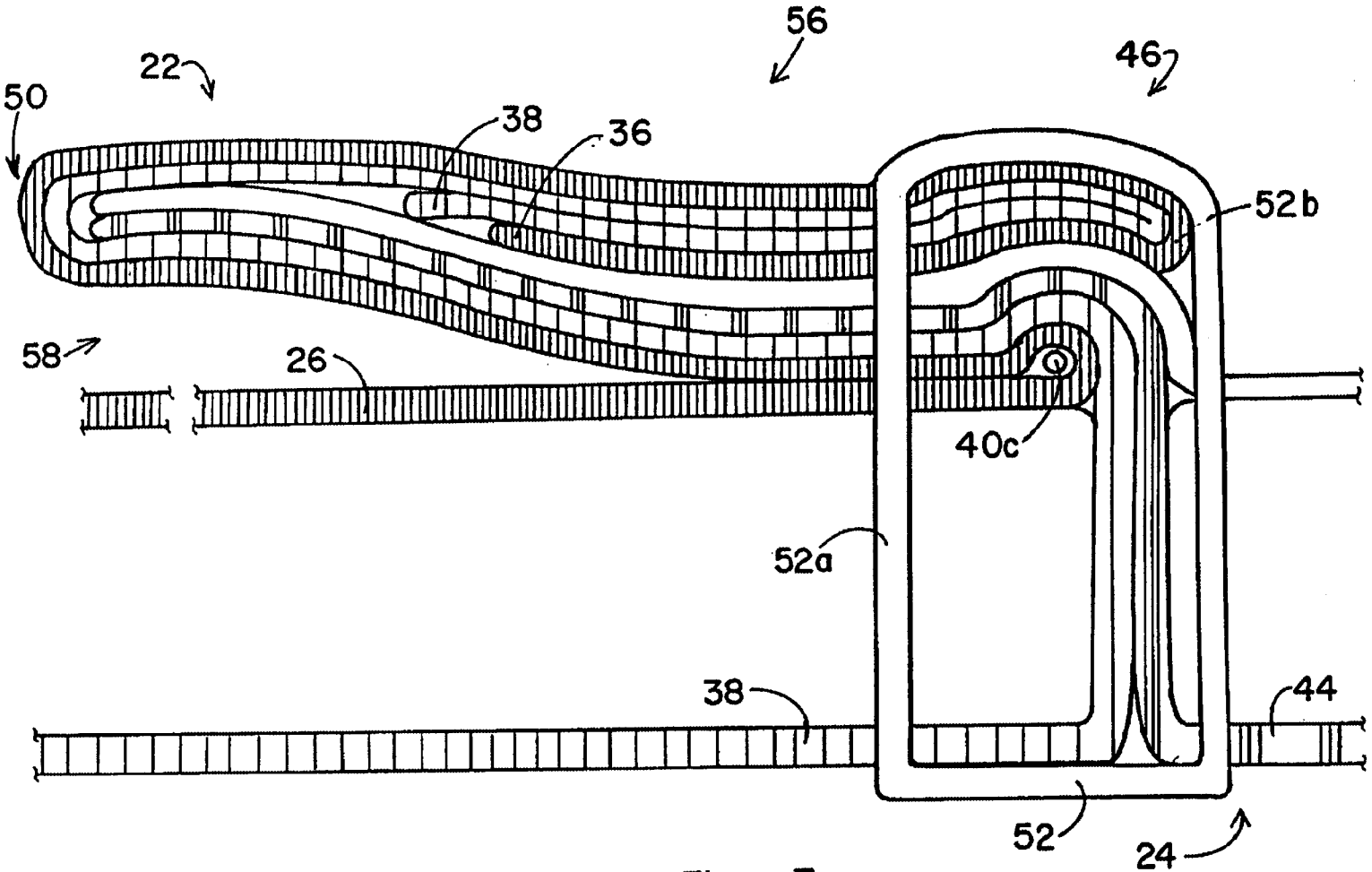
FIG. 7 is a section view of the quilt segment, taken generally along line 7—7 in FIG. 4.

As shown in FIG. 4, and prior to finishing stitching the seam allowances 30 and 32, first quilted piece 26 and second quilted piece 28 are laid out relatively flat. First folded edge 46 is folded to seam line 40 (see for instance, at stitching 40*a*) and defines folded edge line 48. First folded edge 46 is aligned along the length of seam line 40. Seam allowance 30 is stitched over the seam line 40 through to the back face 24 of the quilt segment 20. Seam allowance 30 is stitched at the first folded edge 46 with top stitching 52. Stitching over seam line 40 is accomplished where stitching 52 at least connects first piece back face layer 38 with second piece back face layer 44 as shown in FIG. 5 and FIG. 7. The stitching 52 on the back face retains an identical correspondence with stitching 52 on the front face. Seam allowance 30 is preferably top stitched such that at least a portion of top stitching 52*a* is positioned to the lip-side 56 (or left side) of seam stitch 40*c* and penetrates through to the back face 24.

Top stitching 52 preferably runs along the first folded edge line 48. To most easily accomplish stitching the seam allowance 30 over the seam line 40, and along folded edge line 48, a quilter will position the pressure foot (not shown) of the sewing machine such that the center mark (guideline, or center portion) of the pressure foot is positioned directly above seam line 40*a*. Preferably, the quilter will set the stitch width such that the stitch 52*a* is positioned to the lip-side 56 of seam line 40*c*. It can be appreciated that a quilter may instead position the pressure foot such that the guideline is positioned to the lip-side 56 of seam line 40*c* (such as stitch 52*a*). In this case the quilter will preferably set the stitch width such that the stitch 52*b* is positioned directly above seam line 40*a*. It can be appreciated that stitch 52*b* may on occasion penetrate seam allowance 30 to the lip-side 56 of folded edge line 48.

While top stitching 52 is shown as a simple blanket-stitch or button-hole-stitch, it may be appreciated that a variety of decorative stitches can be utilized. Use of a variety of stitches is often appealing to quilters eager to utilize or experiment with new designs which are becoming increasingly common on domestic machines. Preferably a decorative stitch other than a straight stitch is utilized in order to assure a stitch width that covers the stitch 40*c* or which at least covers seam line 40*b*.

As shown in FIG. 7, stitching 52 is positioned over the stitch of seam line 40*c*. The stitch of seam line 40*a* is concealed in FIG. 7 by stitching 52. After folding and stitching, seam line 40*c* is no longer in plain view. Preferably, and as shown in FIG. 7, stitching 52 laps over first folded edge 46 and folded edge line 48. Applicant recognizes that not all quilters can maintain a straight line or route when stitching along seam line 40 and thus contemplates an occasional stitch portion 52*b* that might penetrate the first folded edge 46 toward the lip-side 56 of folded edge line 48. Likewise, an occasional stitch portion 52*b* might stray opposite the direction of lip-side 56 (or to the right side). Moreover, some quilters may set their stitch width such that the distance between stitch portion 52*a* and 52*b* is narrow (and in some cases non-existent as with older machines, or in other cases vary wide) such that a slight deviation may cause an occasional stitch to not lie over seam line 40. As preferably shown in FIG. 5 which depicts the back face 24 of quilt segment 20, each of the back side stitchings 52 is aligned over the seam line 40*b*. As shown in FIGS. 6 and 7, seam allowances 30 and 32 are folded to a left side or lip-side 56 of seam line 40. FIG. 7 shows stitching 52*a* penetrating through eleven layers of fabric and batting.

As shown in FIG. 7, lip 56 is defined in part by second folded edge 50. Lip 56 is unstitched such that the second folded edge 50 may project or be raised from the front face 22. Lip 56 and first piece 26 define a clearance 58 which runs the length of the quilt segment 20. While lip 56 may on occasion lay flat, its unattached folded edge 50 provides further dimensions to quilt segment 20. Lip 56 provides a unique raised feel, special comfort aspects, a gripping aspect, 3-Dimensional aspect, as well as a visual attention device. Lip 56 is finished in that there are no exposed raw edges. The raw edges are concealed.

FIG. 8 shows a section view of a further aspect of the present invention where left batting 54 is positioned between front face layer 36 and back face layer 38, and right batting 55 is positioned between second piece front face layer 42 and second piece back face layer 44. Each of right batting 55 and left batting 54 include a batting edge 60 stitched within stitching of seam line 40. While it is preferred that each of battings 54 and 55 are stitched within the seam line 40, this might not be accomplished in all cases or along the complete edge of the battings 54, 55. It can be appreciated that depending on sewing abilities or preferences, and at any given point along the seam line 40, both battings, a single batting, or no batting may be stitched within the seam line 40.

Figure 9:
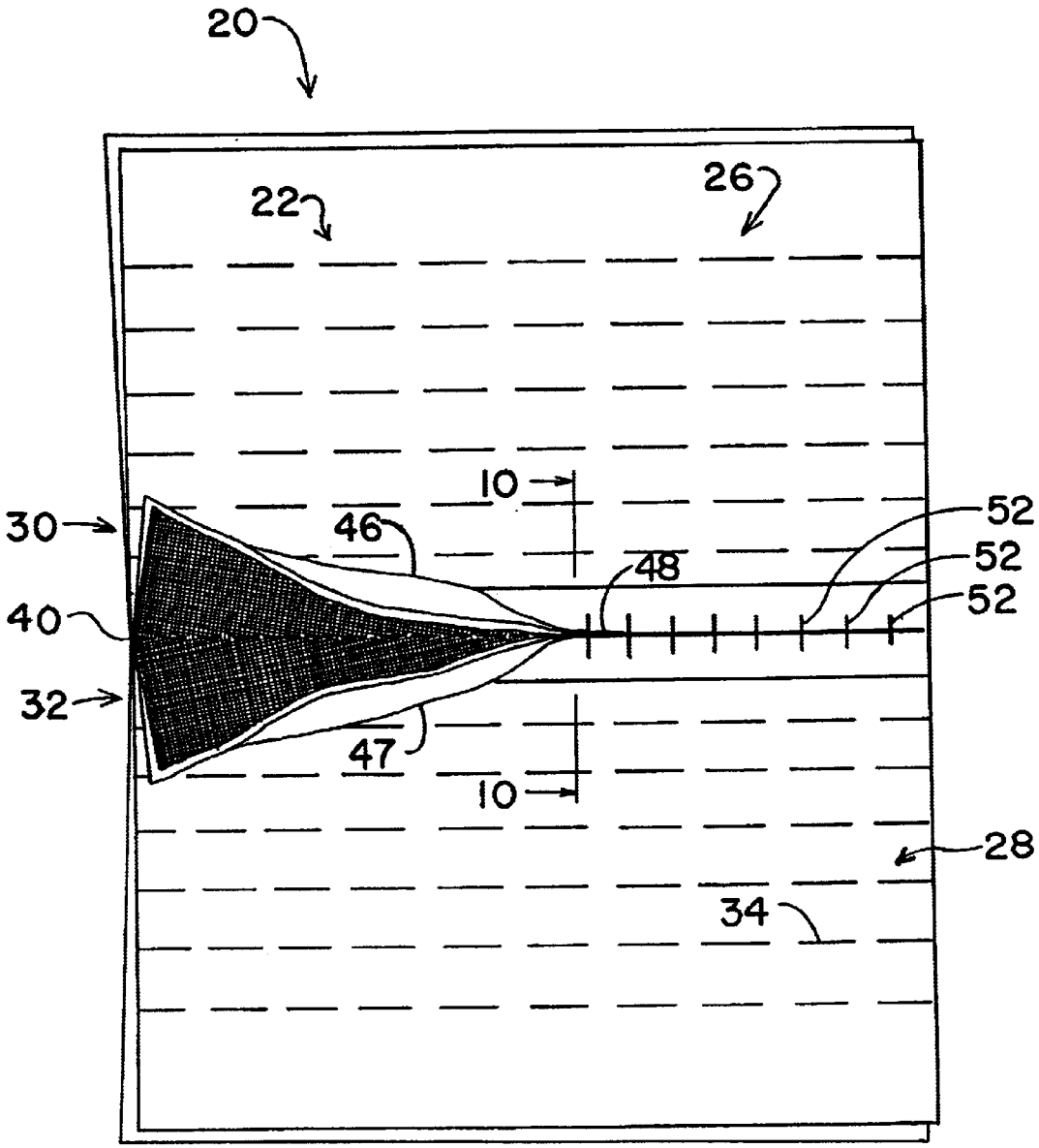
FIG. 9 is a top perspective view of a quilt segment partially made in accordance with the present invention having partially folded and partially stitched seam allowances.
Figure 10:
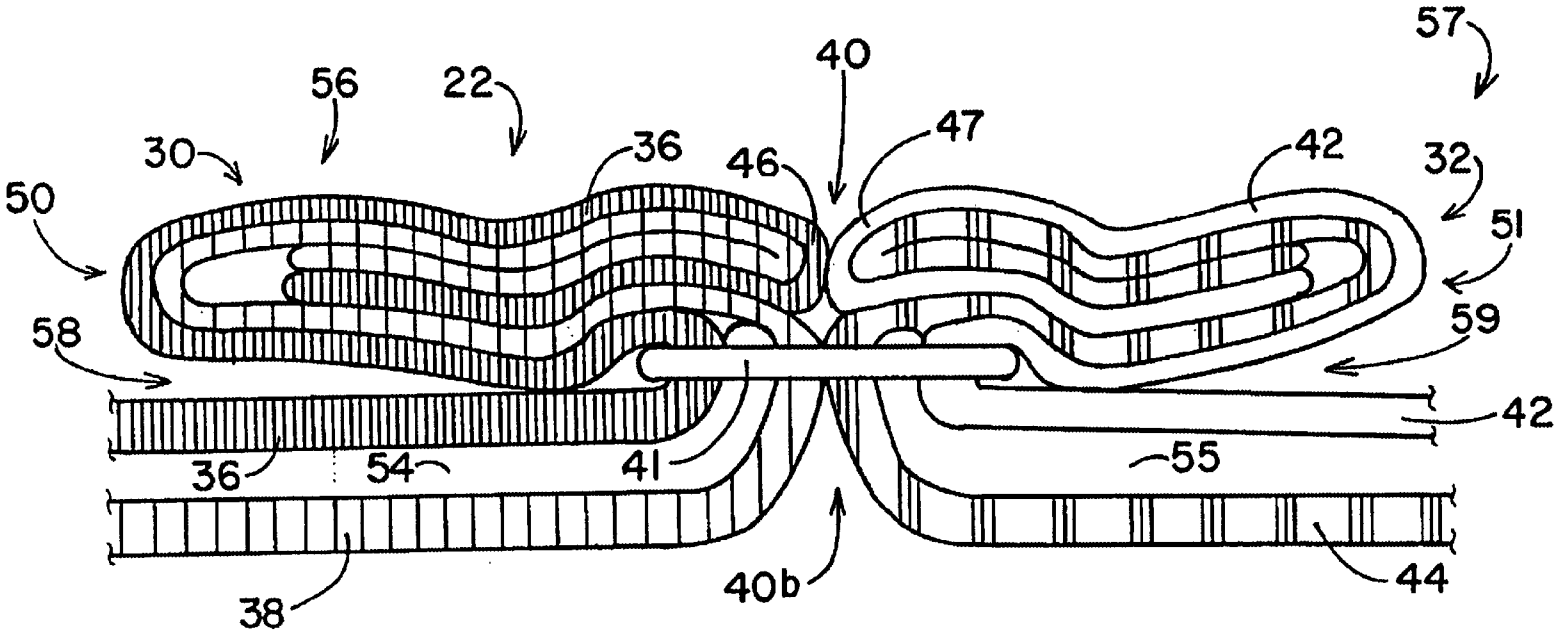
FIG. 10 is a section view of the quilt segment, taken generally along line 10—10 in FIG. 9.

FIGS. 9 and 10 show a further aspect of the present invention where seam allowance 30 is folded to a left side of seam line 40 and seam allowance 32 is folded to a right side of seam line 40. Each seam allowance 30 and 32 is double folded such that no raw edges are exposed. Left side first folded edge 46 is folded to seam line 40 and defines folded edge line 48. As shown, folded edge 46 is created by folding seam allowance 30 in a clock-wise fashion. Left side first folded edge 46 is aligned along the length of seam line 40. Right side first folded edge 47 is folded to seam line 40 and further defines folded edge line 48. Right side first folded edge 47 is aligned along the length of seam line 40. Seam allowances 30 and 32 are stitched along the folded edges 46 and 47 with top stitching 52. Top stitching 52 may be of any desired design other than a zero-width straight-stitch. Preferably seam allowances 30 and 32 are stitched with a single or common stitching 52. Lips 56, 57 are defined in part by left second folded edge 50 and right second folded edge 51, respectively. Lips 56, 57 are unstitched such that the second folded edges 50, 51 may project or be raised from the front face 22. Lips 56, 57 define clearances 58, 59 which run the length of the quilt segment 20. While lips 56, 57 may on occasion lay flat, their unattached folded edges 50, 51 provides further dimensions to quilt segment 20.

Figure 11:
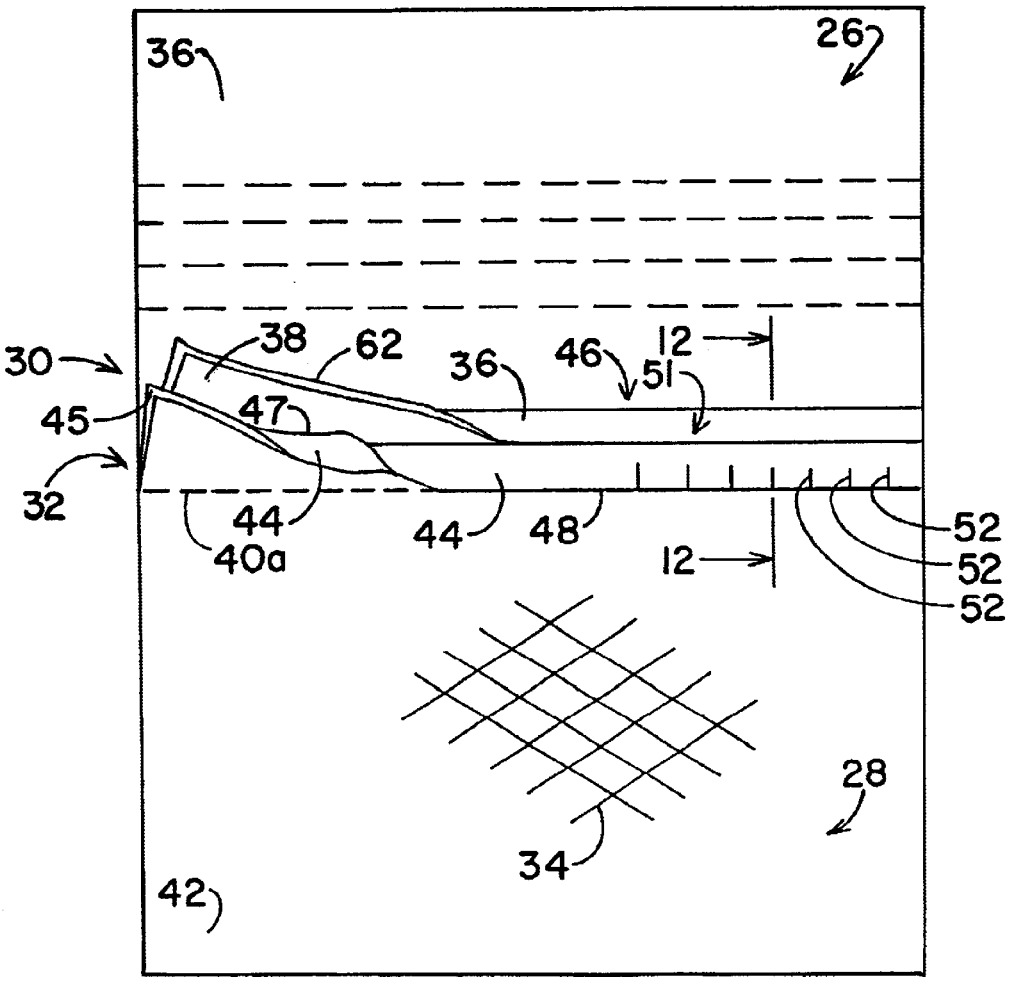
FIG. 11 is a top view of a quilt segment partially made in accordance with the present invention having two lips.
Figure 12:
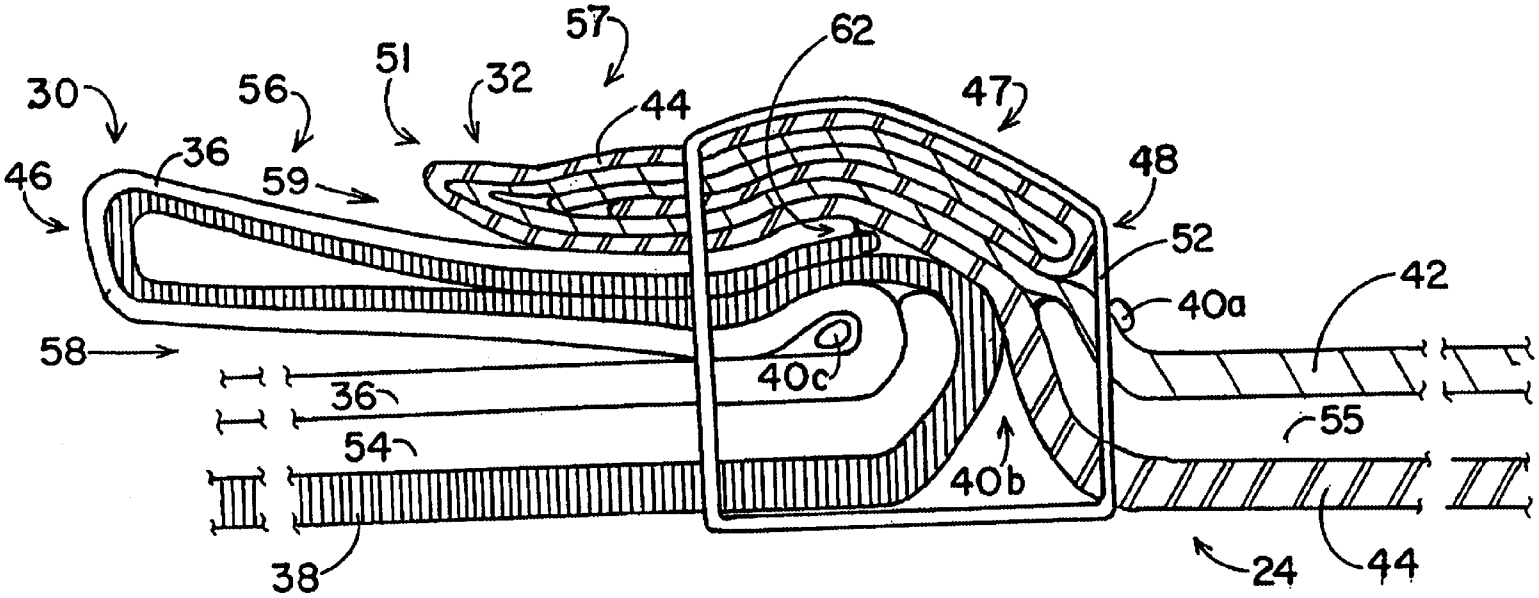
FIG. 12 is a section view of the quilt segment taken along line 12—12 in FIG. 11.

FIGS. 11 and 12 show a further aspect of the present invention where the quilt segment 20 includes lips 56, 57. Lip 56 is formed by folding seam allowance 30 and lip 57 is formed by folding seam allowance 32 as shown. Seam allowance 30 is preferably single folded to a left side (or lip-side 56) and defines a first folded edge 46. As shown, folded edge 46 is created by folding seam allowance 30 in a clockwise fashion. It may be appreciated that seam allowance 30 may also be folded in a counter-clockwise fashion. In such case, first piece back face layer 38 and second piece back face layer 44 are visible on the front side of segment 20. First piece raw edges 62 are preferably folded to or adjacent seam line 40*c*. Seam allowance 32 is preferably double folded to the left side and defines a first folded edge 47 and a second folded edge 51. The folded seam allowance 32 covers the raw edge 62. First folded edge 47 is aligned along the length of seam line 40. Seam allowance 32 is stitched over the seam line 40 through to the back face 24 of the quilt segment 20. Seam allowance 32 is preferably stitched over the first folded edge 47 with top stitching 52. As shown in FIG. 5 which also depicts the back face 24 of quilt segment 20 of the present aspect, each of the back side stitchings 52 is aligned over the seam line 40*b*. Stitching over seam line 40 is accomplished where stitching 52 at least connects first piece back face layer 38 with second piece back face layer 44 as shown in FIG. 5 and FIG. 12.

While top stitching 52 is shown as a simple blanket-stitch, it may be appreciated that a variety of decorative stitches can be utilized. As shown in FIG. 12, stitching 52 is positioned over the stitch of seam line 40*c*. After folding and top-stitching, seam line 40*c* is no longer in plain view. Preferably, and as shown in FIG. 12, stitching 52 laps over first folded edge 47 and folded edge line 48. Applicant recognizes that not all quilters can maintain a straight line stitch when stitching along seam line 40 and thus contemplates an occasional stitch that might penetrate the first folded edge 47. Likewise, an occasional stitch might stray opposite the direction of lip-side 57 (or right side). Lip 56 and first piece 26 define a clearance 58 which runs the length of the quilt segment 20. While lip 56 may on occasion lay flat, its unattached folded edge 46 provides further dimensions to quilt segment 20. Lip 56 provides a unique raised feel, special comfort aspects, a gripping aspect, as well as a visual attention device. Lip 56 is finished in that there are no exposed raw edges. Lip 57 and first piece 26 also define clearance 59 which runs the length of the quilt segment 20. Lip 57 has unattached folded edge 51 which provides further dimensions to quilt segment 20. The foregoing double lip configuration provides the extra dimensions as mentioned, provides for a unique double raised feel, and also allows for the second piece back face layer 44 to be folded so as to be visible at the front face 22. Reference numeral 45 corresponds to the underside of the surface of second piece back face layer 44. Since the back face layer 44 can be visible from the front of a finished seam, unique color patterns can be established as desired. A resulting quilt may be reversible in that the color schemes on the front face may also exist at the back face and vice verse.

Figure 13:
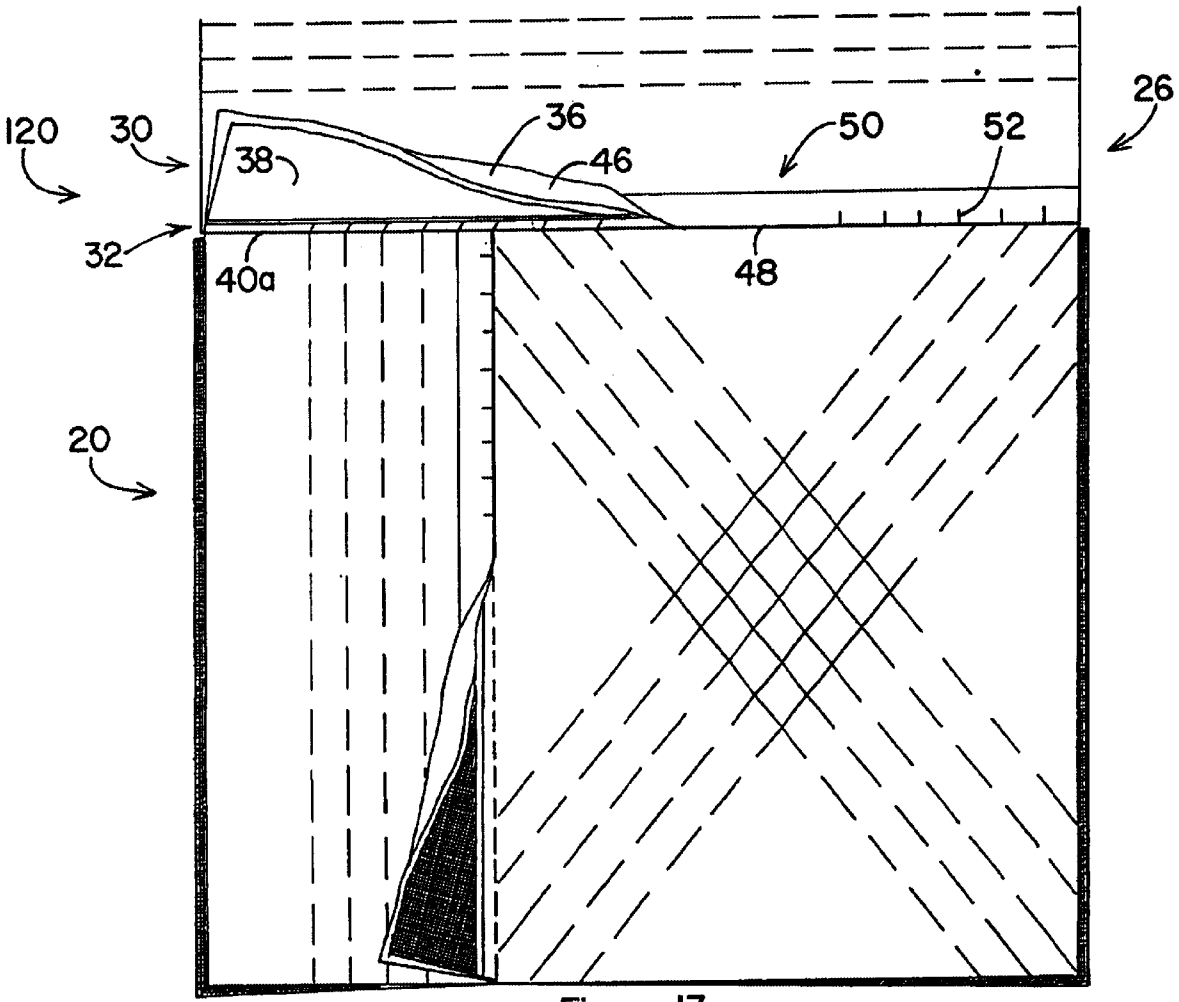
FIG. 13 is a top view of a quilt partially made in accordance with the present invention.

FIG. 13 shows a quilt segment 120 made in accordance with a further aspect of the present invention where quilt segment 20 is stitched to a first quilted piece 26. It may be appreciated that the techniques shown above corresponding to FIG. 4 may be used to create the quilt segment 120 having finished seam allowances 30 and 32. FIG. 13 depicts quilt segment 20 having trimmed seam allowance 32 which is folded within seam allowance 30. Seam allowance 30 is double folded as described above. It can be appreciated that any number of quilt segments 20 and 120 can be connected according to this described method to create a finished reversible quilt. A quilter may connect segment 20 with piece 26 so that the front face 22 of quilt segment 20 corresponds to a back face 24 of quilt segment 120. Thus, corresponding quilt segments 20 can be connected with both is front faces 22 showing to the front, or with the front face of one segment 20 and the back face of another segment 20 showing to the front.

The foregoing methods and configurations allow a quilter to in essence create two quilts at one time, or in other words to create a reversible quilt. The reversibility is accomplished where each side may contain finished lips. Each side is therefore desirable. Moreover, one side is identical or nearly identical to the other with respect to pattern or design (as opposed to color). Further, the colored fabric on one side may also appear on the other side due to the unique finishing of the seam allowances as described herein. The foregoing methods may also be used to finish seam allowances where one of the fabric pieces or segments consist of a traditional quilt block or piece.

Once the desired number and dimension (and color schemes or patterns) of quilt segments 20 and 120 are combined, a quilter may use any number of traditional binding techniques to finish the raw edges of the resulting quilt.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim is expressed as a means or step for performing a specified function it is intended that such claim be construed to cover the corresponding structure, material, or acts described in the specification and equivalents thereof, including both structural equivalents and equivalent structures.

I claim:

1. A method for the fabrication of a quilt segment for use in fabrication of a quilt, said method comprising the steps of:

providing a first piece of fabric having at least one seam allowance;

providing a second piece of fabric having at least one seam allowance;

stitching said first piece to said second piece to form a seam line, said at least one seam allowance of said first piece positioned at a front face of said quilt segment;

folding said seam allowance of said first piece to said seam line;

stitching said folded seam allowance of said first piece through to a back face of said quilt segment and over said seam line.

2. The method according to claim 1 wherein said first piece and said second piece are quilted.

3. The method according to claim 1 wherein said seam allowance of said first piece is at least double folded.

4. The method according to claim 3 wherein said folded seam allowance is stitched along a first folded edge through to said back face.

5. The method according to claim 4 wherein said first piece is at least double folded to create a second folded edge, stitching said folded seam allowance of said first piece along said first folded edge over said seam line through to a back face of said quilt segment, said second folded edge defining a finished lip.

6. The method according to claim 1 wherein said at least one seam allowance of said second piece is folded with said seam allowance of said first piece.

7. The method according to claim 6 wherein said at least one seam allowance of said second piece is trimmed before folding with said seam allowance of said first piece.

8. The method according to claim 1 wherein said at least one seam allowance of said second piece is enclosed within said seam allowance of said first piece.

9. The method according to claim 1 wherein each stitch of said stitching is positioned over said seam line.

10. The method according to claim 1 wherein said first piece includes a front face layer stitched to a back face layer.

11. The method according to claim 10 wherein said first piece includes a batting positioned between said front face layer and said back face layer.

12. The method according to claim 11 wherein at least a portion of said at least one seam allowance of said first piece extends beyond said batting.

13. The method according to claim 10 wherein said at least one seam allowance of said first piece is defined by a portion of said front face layer and a portion of said back face layer.

14. The method according to claim 13 wherein said front face layer portion is folded to a right side of said segment and said back face layer portion is folded to a left side of said segment.

15. The method according to claim 1 wherein said second piece is a quilt segment fabricated according to said method.

16. The method according to claim 1 wherein said first piece is a quilt segment fabricated according to said method.

17. The method according to claim 1 wherein said at least one seam allowance of said first piece is folded to a left side of said segment and said at least one seam allowance of said second piece is folded to a right side of said segment.

18. The method according to claim 17 including the step of folding said seam allowance of said second piece to said seam line.

19. The method according to claim 18 including the step of stitching said folded seam allowance of said second piece over said seam line through to said back face of said quilt segment.

20. The method according to claim 19 wherein said step of stitching said folded seam allowance of said first piece and said step of stitching said folded seam allowance of said second piece are the same.

21. A method for the fabrication of a quilt segment for use in fabrication of a quilt, said method comprising the steps of:

providing a first piece of fabric having at least one seam allowance;

providing a second piece of fabric having at least one seam allowance;

stitching said first piece to said second piece to form a seam line, said at least one seam allowance of said first piece positioned at a front face of said quilt segment and having a raw edge;

at least single folding said seam allowance of said first piece to a left side of said segment to define a first piece folded edge, said raw edge folded to said seam line;

at least double folding said at least one seam allowance of said second piece to said left side to define a second piece first folded edge and a second piece second folded edge, said seam allowance of said second piece covering said raw edge, said second piece first folded edge folded to said seam line;

and stitching said seam allowance of said second piece through to a back face of said quilt segment and over said seam line, said first piece folded edge and said second piece second folded edge each defining a finished lip.

22. A method for the fabrication of a quilt segment for use in fabrication of a quilt, said method comprising the steps of:

providing a first piece of fabric having at least one seam allowance;

providing a second piece of fabric having at least one seam allowance;

stitching said first quilted piece to said second quilted piece to form a seam line, said at least one seam allowances of said first and said second quilted pieces positioned at a front face of said quilt segment;

at least double folding said seam allowance of said first quilted piece to create a first folded edge and a second folded edge;

stitching said first folded edge through to a back face of said quilt segment, said second folded edge projecting from said front face.

23. The method according to claim 22 including the step of at least double folding said seam allowance of said second piece to create a second piece first folded edge, and stitching said second piece first folded edge through to said back face of said quilt segment.

24. The method according to claim 23 wherein said first folded edge and said second piece first folded edge are stitched in a single step.

25. The method according to claim 22 wherein said at least one seam allowance of said second piece is enclosed within said seam allowance of said first piece.

26. The method according to claim 22 wherein said first piece and said second piece are quilted and wherein said stitching of said first folded edge is positioned over said seam line.

27. A quilt comprising:

at least one first segment comprising:

a first piece having at least one seam allowance positioned at a front face of said first segment;

a second piece having at least one second seam allowance, said first piece stitched to said second piece at a seam line;

said seam allowance of said first piece stitched over said seam line through to a back face of said first segment;

said first segment having a first segment seam allowance;

at least one second segment having at least one second segment seam allowance, said first segment stitched to said second segment at a second seam line;

said seam allowance of said second segment folded to define a first folded edge, said first folded edge folded to said second seam line;

said first folded edge stitched through to a back face of said quilt and over said second seam line.

28. The quilt according to claim 27 wherein said first segment seam allowance is enclosed within said folded seam allowance of said second segment.

29. The quilt according to claim 27 wherein said at least one second segment includes a seam allowance positioned at a back face of said quilt.

30. A quilt segment for use in fabrication of a quilt, said quilt segment comprising:

a first piece of fabric having at least one seam allowance;

a second piece of fabric having at least one seam allowance;

said first piece stitched to said second piece defining a seam line, said at least one seam allowance of said first piece positioned at a front face of said quilt segment;

said seam allowance of said first piece folded to said seam line;

said folded seam allowance of said first piece stitched over said seam line through to a back face of said quilt segment.

31. The quilt segment according to claim 30 wherein said seam allowance of said first piece is at least double folded.

32. The quilt segment according to claim 31 wherein said folded seam allowance is stitched at a first folded edge over said seam line through to said back face.

33. The quilt segment according to claim 30 wherein said at least one seam allowance of said second piece is enclosed within said seam allowance of said first piece.

34. The quilt segment according to claim 30 wherein said seam allowance of said first piece defines a finished lip.

35. The quilt segment according to claim 30 wherein said first piece and said second piece are quilted, said seam allowance of said first piece defines a first finished lip and said seam allowance of said second piece defining a second finished lip.

36. The quilt segment according to claim 35 wherein said first finished lip is positioned to a left side of said seam line and said second finished lip is positioned to a right side of said seam line.

37. A quilt segment for use in fabrication of a quilt, said quilt segment comprising:

a first piece of quilted fabric stitched to a second piece of quilted fabric defining a seam line and a first piece seam allowance and a second piece seam allowance, each of said seam allowances positioned at a front face of said quilt segment;

said first seam allowance double folded and enclosing said second seam allowance;

a folded edge of said first seam allowance aligned with said seam line and stitched over said seam line through to a back face of said quilt segment.

* * * * *